US008459834B2

(12) United States Patent
Chang

(10) Patent No.: US 8,459,834 B2
(45) Date of Patent: Jun. 11, 2013

(54) LED LIGHTING BAR

(76) Inventor: Chia-Hao Chang, Shuliin (TW)

( * ) Notice: Subject to any disclaimer, the term of this patent is extended or adjusted under 35 U.S.C. 154(b) by 0 days.

(21) Appl. No.: 12/905,123

(22) Filed: Oct. 15, 2010

(65) Prior Publication Data

US 2011/0096545 A1 Apr. 28, 2011

(30) Foreign Application Priority Data

Oct. 22, 2009 (TW) ..... 98219524 U

(51) Int. Cl.
*F21S 4/00* (2006.01)
*F21V 21/00* (2006.01)

(52) U.S. Cl.
USPC ..... 362/249.02; 362/219; 362/222; 362/240

(58) Field of Classification Search
USPC ..... 362/249.02, 555, 559, 219, 222–224, 362/227, 230, 231, 240
See application file for complete search history.

(56) References Cited

U.S. PATENT DOCUMENTS

| | | | | |
|---|---|---|---|---|
| 4,774,642 | A | 9/1988 | Janko et al. | |
| 6,619,813 | B1 * | 9/2003 | Schnell | 362/116 |
| 6,739,735 | B2 * | 5/2004 | Talamo et al. | 362/237 |
| 6,739,831 | B2 * | 5/2004 | Hsu et al. | 415/60 |
| 7,303,315 | B2 * | 12/2007 | Ouderkirk et al. | 362/294 |
| 2003/0137839 | A1 * | 7/2003 | Lin | 362/249 |
| 2005/0092517 | A1 * | 5/2005 | Fan | 174/117 FF |
| 2005/0117356 | A1 | 6/2005 | Lin | |
| 2008/0123334 | A1 * | 5/2008 | Hochstein | 362/249 |
| 2008/0266858 | A1 * | 10/2008 | Southard et al. | 362/249 |

FOREIGN PATENT DOCUMENTS

| | | | |
|---|---|---|---|
| EP | 1733653 | A2 | 12/2006 |
| TW | M316972 | | 8/2007 |
| WO | 2007041805 | A1 | 4/2007 |
| WO | 2009086032 | A1 | 7/2009 |

OTHER PUBLICATIONS

Search Report, European Search report Jan. 28, 2011 Application 10188149.8-1268.

* cited by examiner

*Primary Examiner* — Evan Dzierzynski
*Assistant Examiner* — Danielle Allen
(74) *Attorney, Agent, or Firm* — Chun-Ming Shih; HDLS IPR Services

(57) ABSTRACT

The LED lighting bar includes a first conductive wire (10), a second conductive wire (20) parallel to the first conductive wire (10), an insulator (30), at least one LED (40) and a fixing frame (50, 50'). The insulator (30) has an upper layer (31, 31') and a lower layer (32, 32'), which cover the first conductive wire (10) and the second conductive wire (20), wherein the upper layer (31, 31') is provided with a penetrating trough (310, 310') for exposing a first connecting section (11) of the first conductive wire (10) and a second connecting section (21) of the second conductive wire (20). The at least one LED (40) electrically connects on a first electrode (41) of the first connecting section (11) and a second electrode (42) of the second connecting section (21). The fixing frame (50, 50') is around the at least one LED (40) for fastening.

6 Claims, 6 Drawing Sheets

LED LIGHTING BAR

BACKGROUND OF THE INVENTION

1. Technical Field

The invention relates to lighting devices, particularly to LED lighting bars.

2. Related Art

Because light emitting diodes (LEDs) feature low power consumption, long durability, small volume and quick response, they are replacing conventional bulbs in various lighting devices such as decorative lighting bars.

A typically conventional LED lighting bar is disclosed in Taiwan patent No. M316972 (hereinafter "TW972"). TW972 includes an inner fixing seat, an LED string and an outer fixing body. The LED string is composed of LED units, a wire set and a flexible circuit board. The LED string is inserted into the inner fixing seat, and the outer fixing body covers the inner fixing seat and LED string to form an integrated lighting bar.

In the structure of TW972, the LED must be soldered on the flexible circuit board first, and the outer fixing body and inner fixing seat are assembled by an extrusion process to sheathe the LED string. Thus, this assembling and manufacturing process is complicated and time-consuming. Moreover, the LEDs and their electric connection tend to be damaged because of pressure. And the damaged LEDs accommodated in the fixing body are difficult to be repaired. As a result, the yield rate of the LED string is not good enough and the costs of the LED string are too high.

SUMMARY OF THE INVENTION

A primary object of the invention is to provide an LED lighting bar which can simplify the connection and fixation of lighting bars.

A secondary object of the invention is to provide an LED lighting bar which can efficiently reduce the costs of lighting bars.

To accomplish the above objects, the LED lighting bar of the invention includes a first conductive wire, a second conductive wire parallel to the first conductive wire; an insulator; at least one LED and a fixing frame. The insulator has an upper layer and a lower layer, which cover the first conductive wire and the second conductive wire, wherein the upper layer is provided with a penetrating trough for exposing a first connecting section of the first conductive wire and a second connecting section of the second conductive wire. The at least one LED electrically connects on a first electrode of the first connecting section and a second electrode of the second connecting section. The fixing frame is around the at least one LED for fastening.

In comparison with the conventional LED lighting bars, the upper layer of the insulator of the invention is provided with a penetrating trough to expose the first and second connecting section. The LED is placed on the first and second connecting section and is fastened by the fixing frame. Because the LED is mounted on the insulator by the fixing frame, the complicated soldering and extrusion process can be retrenched. Thus the connection and fixation of the LED is simplified.

DETAILED DESCRIPTION OF THE INVENTION

Figure 1:
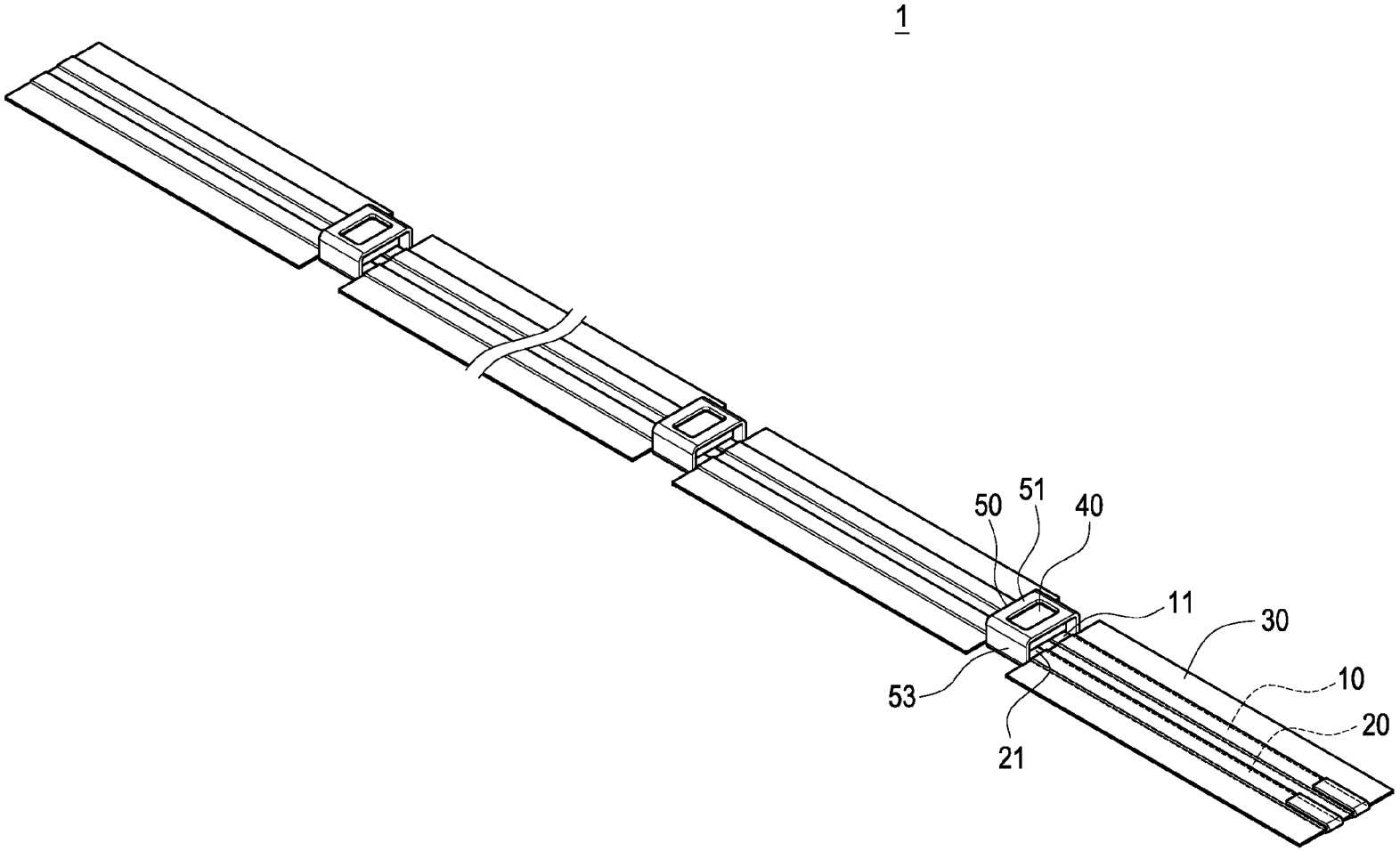
FIG. 1 is a perspective view of the LED lighting bar.
Figure 2:
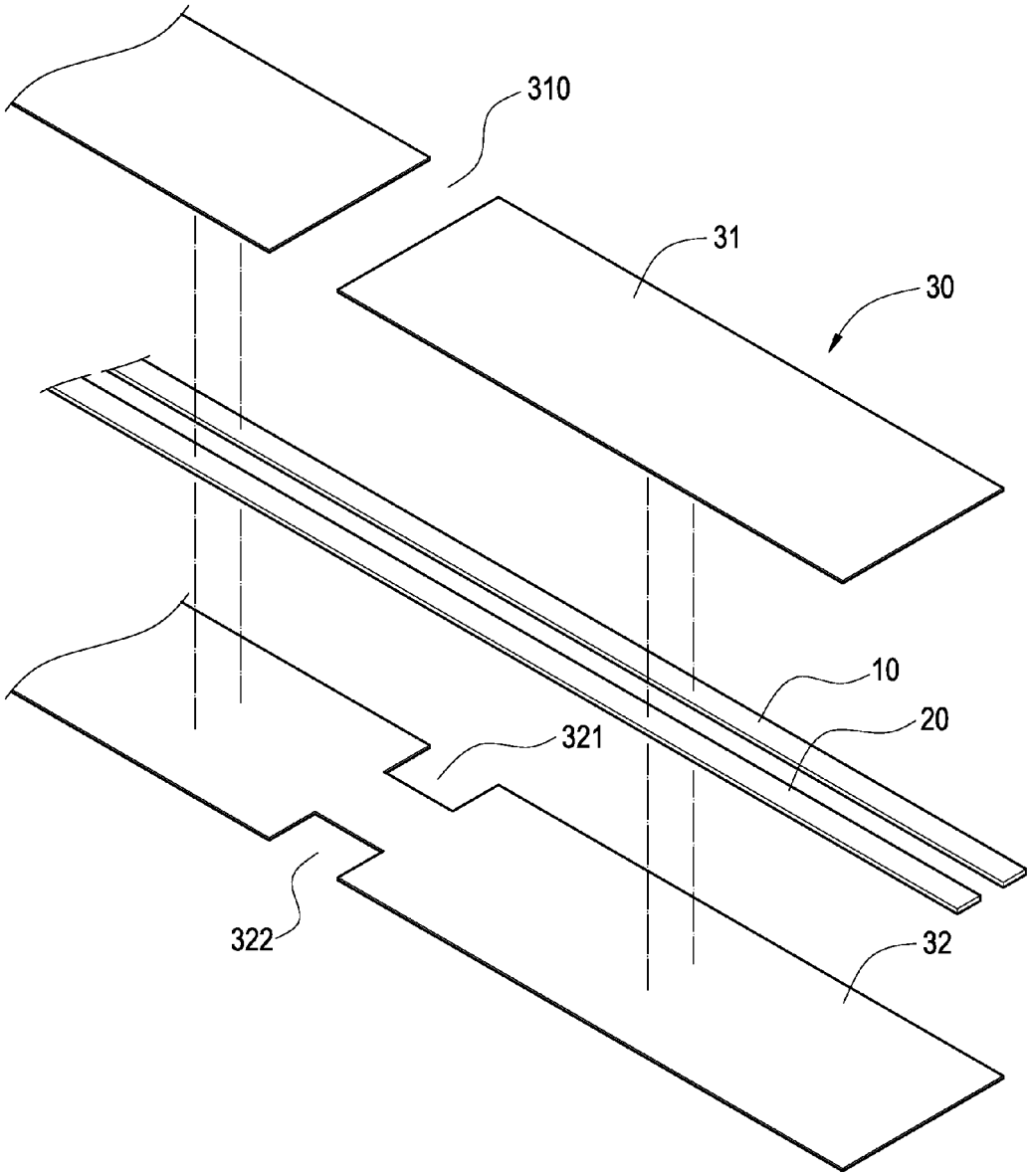
FIG. 2 is an exploded perspective view of the insulator and wires.
Figure 3:
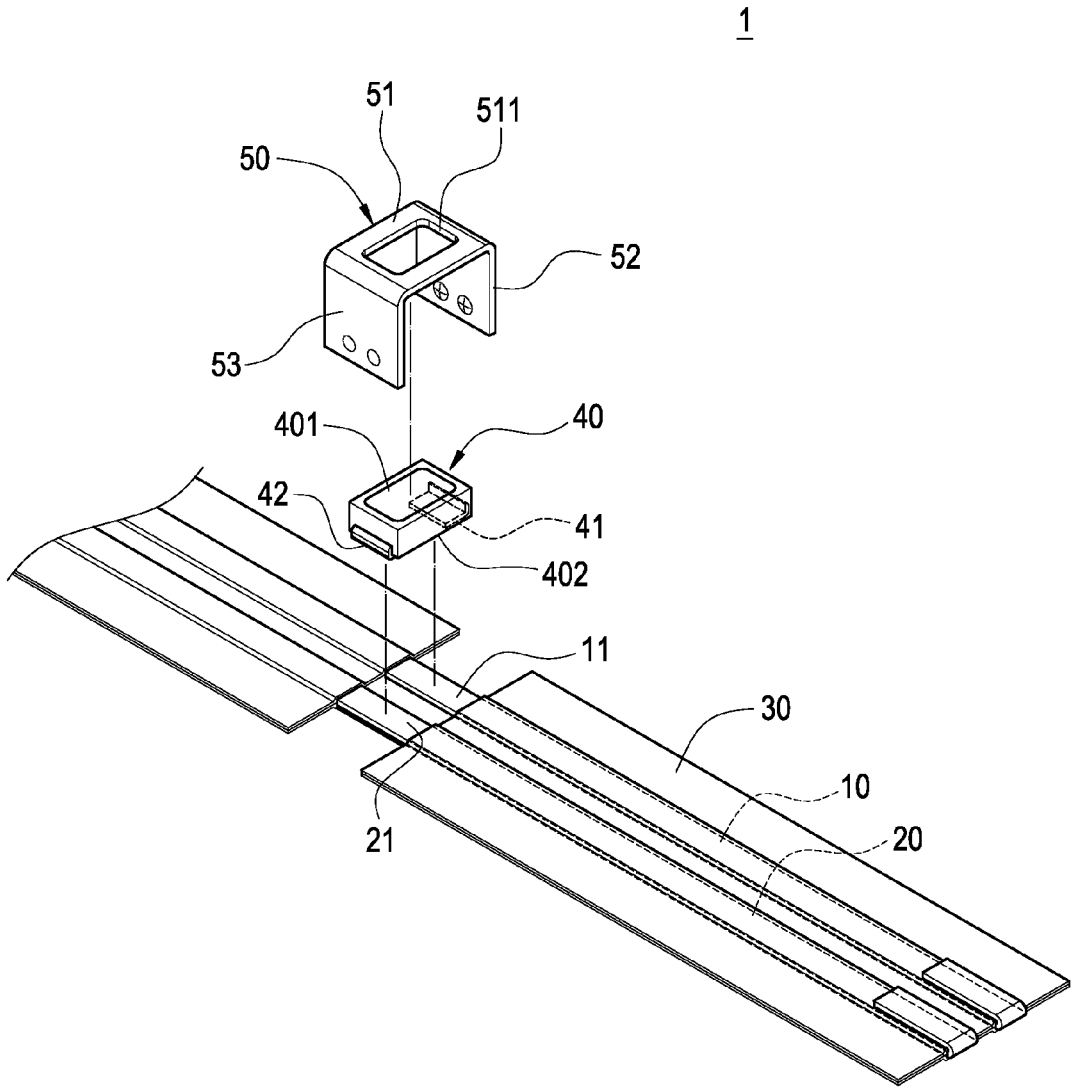
FIG. 3 is an exploded perspective view of the LED lighting bar.
Figure 4:
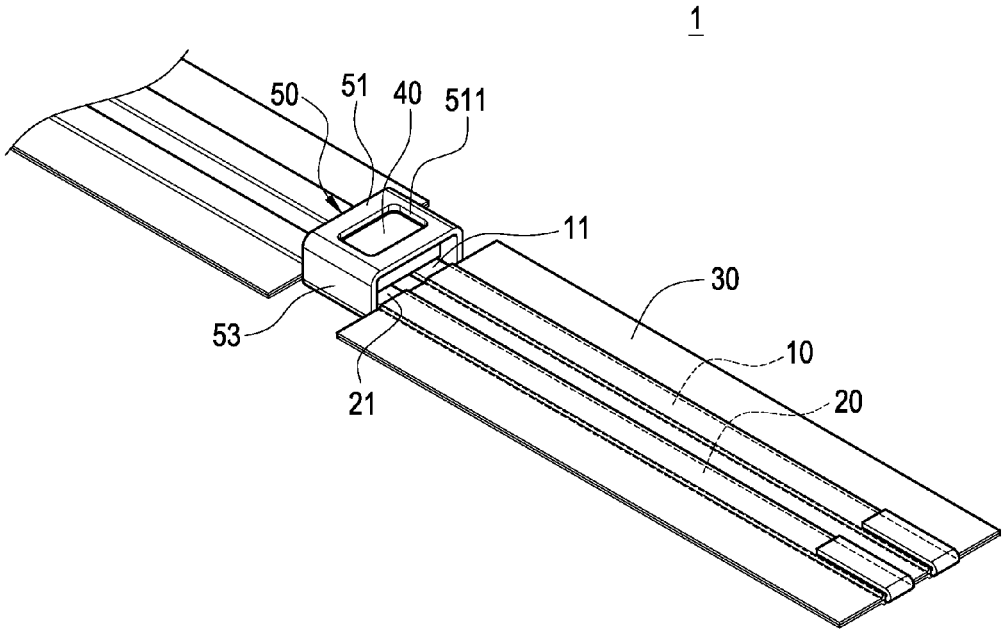
FIG. 4 is an assembled schematic view of the LED lighting bar.

FIGS. 1-4 are an assembled perspective view, an exploded perspective view of the insulator and wires, an exploded perspective view of the LED lighting bar and an assembled perspective view, respectively. The lighting bar 1 of the invention includes a first conductive wire 10, a second conductive wire 20, an insulator 30, an LED 40 and a fixing frame 50.

The second conductive wire 20 is parallelly arranged at a lateral side of the first conductive wire 10. The insulator 30 has an upper layer 31 and a lower layer 32, which cover the first conductive wire 10 and the second conductive wire 20. The upper layer 31 is provided with a penetrating trough 310 for exposing a first connecting section 11 of the first conductive wire 10 and a second connecting section 21 of the second conductive wire 20. In the shown embodiment, the insulator 30 is made of plastic material. Two opposite sides of the lower layer 32 are separately provided with two slots 321, 322 corresponding to the first connecting section 11 and second connecting section 21. The slots 321, 322 are arranged for being mounted by the fixing frame 50.

The LED 40 is of an SMD type, and has a lighting side 401, a back side 402, a first electrode 41 and a second electrode 42. The LED 40 is mounted on the first connecting section 11 and the second connecting section 21, and the first electrode 41 and the second electrode 42 are electrically connected to the first connecting section 11 and the second connecting section 21, respectively. In other words, the LED 40 electrically connects to the first conductive wire 10 and the second conductive wire 20.

Figure 5:
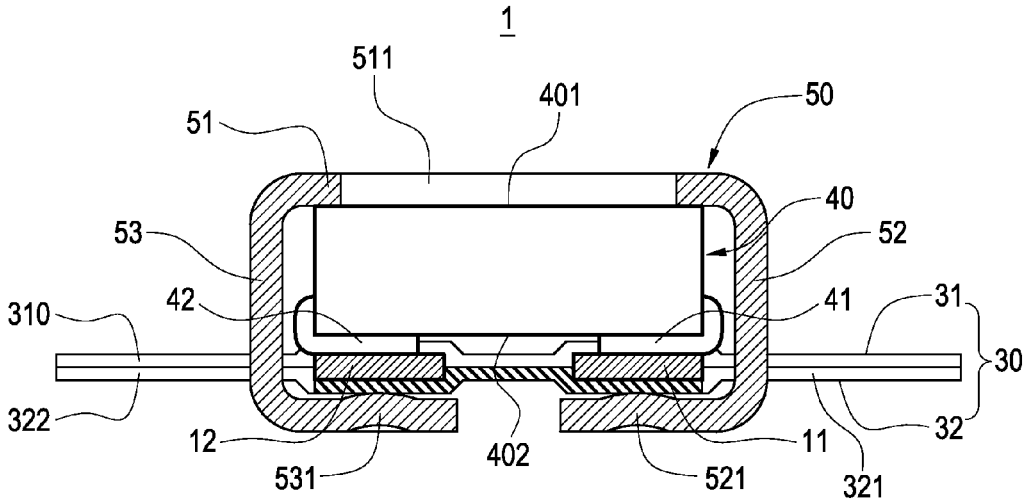
FIG. 5 is a cross-sectional view of the LED lighting bar.

Please refer to FIG. 5. The fixing frame 50 is made of metal and includes a fixing plate 51 and two side plates 52, 53 parallelly extending from two sides of the fixing plate 51. The fixing plate 51 is provided with an opening 511 corresponding to the lighting side 401 of the LED 40. And two blocking sheets 521, 531 separately inwards extend from the side plates 52, 53. The blocking sheets 521, 531 are leaned against by the back side 402 of the LED 40 so that LED 40 is encompassed by the fixing frame 50. Thus the fixing frame 50 with the LED 40 is fixed on the insulator 30.

Figure 6:
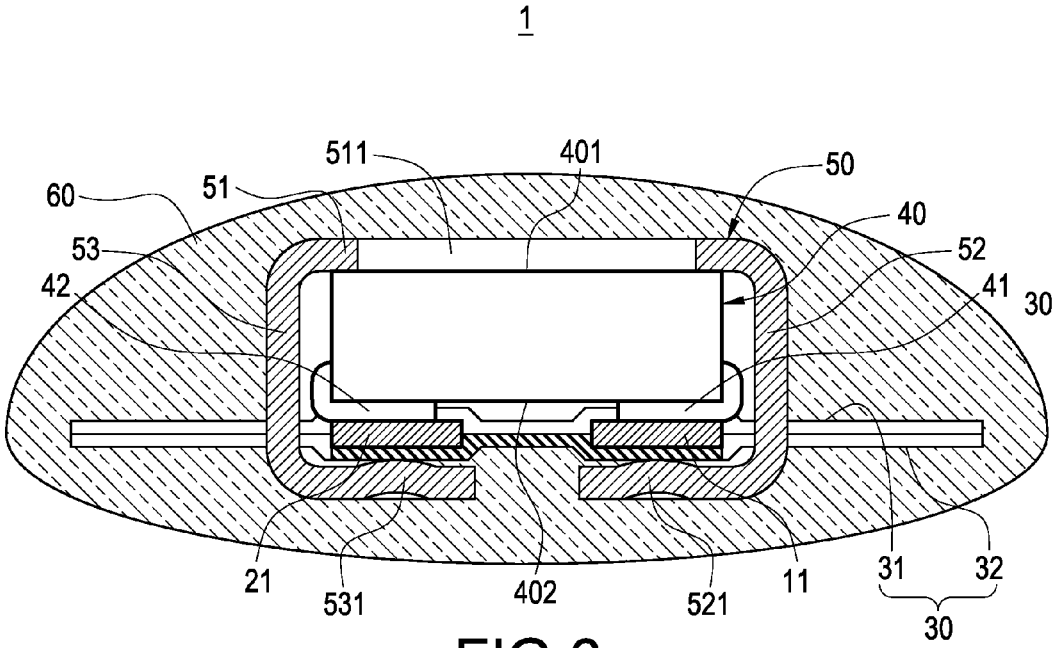
FIG. 6 is a schematic view of an application of the invention.

Please refer to FIG. 6, which shows a schematic view of an application of the invention. The lighting bar 1 further includes a light-permeable body 60 made of light-permeable epoxy resin. The light-permeable body 60 sheathes the LED 40 and fixing frame 50 for providing the LED 40 a protective function of water-resistance and insulation.

Figure 7:
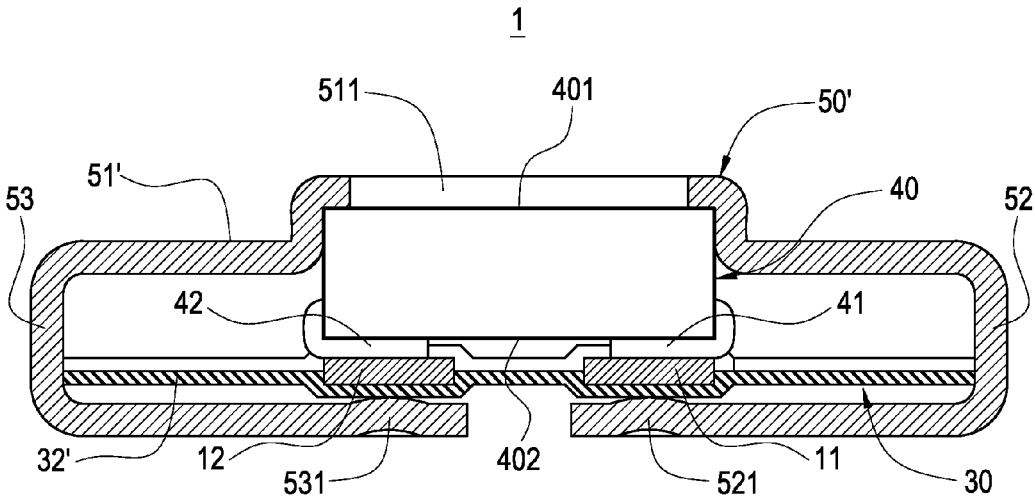
FIG. 7 shows the second embodiment of the invention.

FIG. 7 shows the second embodiment of the invention. In this embodiment, the lower layer 32' is not provided with slots. Hence, the width of the fixing plate 51' must match that of the insulator 30 for making the fixing frame 50' mounted on the insulator 30.

Figure 8:
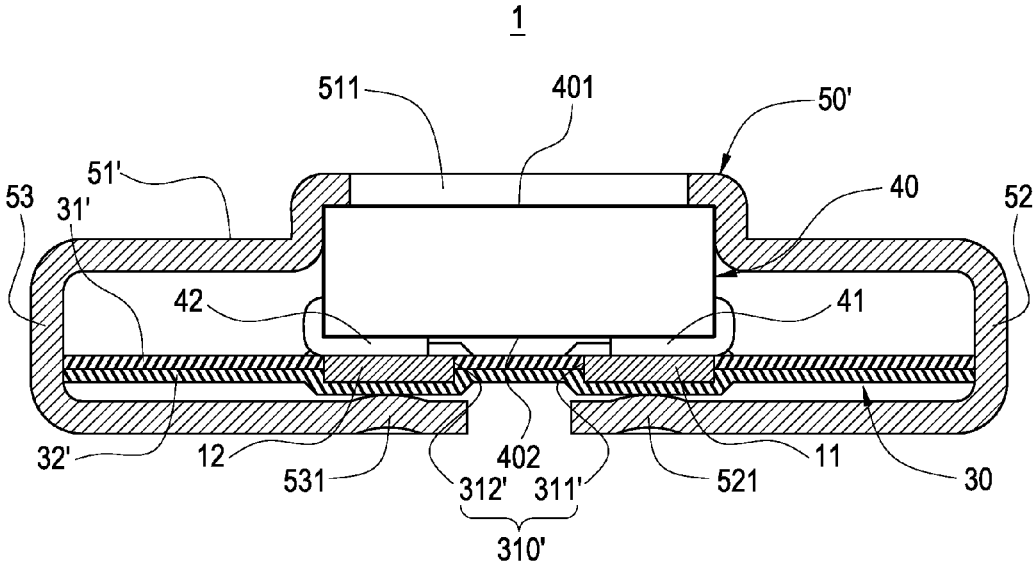
FIG. 8 shows the third embodiment of the invention.

FIG. 8 shows the third embodiment of the invention. In this embodiment, the penetrating trough 310' of the upper layer 31' includes a first penetrating trough 311' and a second penetrating trough 312'. The first penetrating trough 311' and the second penetrating trough 312' are corresponding to the first connecting section 11 and the second connecting section 21, respectively.

While the forgoing is directed to preferred embodiments of the present invention, other and further embodiments of the invention may be devised without departing from the basic scope thereof. As such, the appropriate scope of the invention is to be determined according to the claims.

What is claimed is:

1. A light emitting diode (LED) lighting bar comprising:

a first flat conductive wire (10);

a second flat conductive wire (20) parallel to the first flat conductive wire (10);

an insulator (30) having an upper layer (31) and a lower layer (32), wherein the first flat conductive wire and the second flat conductive wire are disposed on the lower layer, the upper layer is disposed on the lower layer to cover on the first flat conductive wire and the second flat conductive wire, a narrowed portion is provided on the lower layer (32) by forming two cut-outs (321, 322) from two opposite sides at a longitudinal direction of the lower layer (32), and discontinuous portion corresponding to the narrowed portion is formed on the upper layer (31) to expose a first connecting section (11) of the first flat conductive wire (10) and a second connecting section (21) of the second flat conductive wire (20);

at least one LED (40) disposed on the upper layer of the insulator to correspond to the discontinuous portion, having a first bent electrode (41) and a second bent electrode (42) electrically contacted with the first connecting section (11) and the second connecting section (21), respectively; and a fixing frame (50) disposed on the LED (40) to clamp on the lower layer of the insulator, for fastening the LED with secure contact with the first flat conductive wire and the second flat conductive wire, wherein the fixing frame (50) further includes a fixing plate (51) and two side plates (52, 53) parallelly extending from two sides of the fixing plate (51) and passing through the two cut-outs (321, 322), respectively, the fixing plate (51) is provided with a window (511) corresponding to a lighting side (401) of the LED (40), two blocking sheets (521, 531) separately inwards extend from the side plates (52, 53), and the blocking sheets (521, 531) are leaned against the lower layer of the insulator.

2. The LED lighting bar of claim 1, wherein the insulator (30) is made of plastic material.

3. The LED lighting bar of claim 1, wherein the LED (40) is of a surface mount device (SMD) type.

4. The LED lighting bar of claim 1, wherein the fixing frame (40) is made of metal.

5. The LED lighting bar of claim 1, further comprising a light-permeable body (60) sheathing the LED (40) and the fixing frame (50).

6. The LED lighting bar of claim 5, wherein the light-permeable body (60) is made of light-permeable epoxy resin.

* * * * *